US010822813B1

(12) United States Patent
Bunch et al.

(10) Patent No.: US 10,822,813 B1
(45) Date of Patent: Nov. 3, 2020

(54) DEVICE FOR LEVELING AND ALIGNING TILES AND METHOD FOR LEVELING AND ALIGNING TILES

(71) Applicants: Clinton D. Bunch, Keller, TX (US); Joshua A. Bunch, Keller, TX (US)

(72) Inventors: Clinton D. Bunch, Keller, TX (US); Joshua A. Bunch, Keller, TX (US)

( * ) Notice: Subject to any disclaimer, the term of this patent is extended or adjusted under 35 U.S.C. 154(b) by 0 days.

(21) Appl. No.: 16/853,292

(22) Filed: Apr. 20, 2020

Related U.S. Application Data

(60) Provisional application No. 62/836,927, filed on Apr. 22, 2019.

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ..... E04F 21/0092; E04F 21/22
See application file for complete search history.

(56) References Cited

U.S. PATENT DOCUMENTS

| | | | | |
|---|---|---|---|---|
| 3,511,001 | A | 5/1970 | Morgan, Jr. | |
| 3,537,146 | A | 11/1970 | Caveney | |
| 4,286,497 | A | 9/1981 | Shamah | |
| 6,705,021 | B2 | 3/2004 | Nadal et al. | |
| 7,207,145 | B2 | 4/2007 | Stucky et al. | |
| 8,434,285 | B2 | 5/2013 | Harrison | |
| 8,820,031 | B2 * | 9/2014 | Kufner | E04F 15/02 52/749.11 |
| 9,027,308 | B2 | 5/2015 | Kufner et al. | |
| D734,119 | S * | 7/2015 | Kufner | D8/105 |
| 9,464,448 | B2 * | 10/2016 | Hoffman | E04F 21/0092 |
| 9,874,032 | B1 * | 1/2018 | Chen | E04F 21/0092 |
| 10,260,243 | B1 * | 4/2019 | Chen | E04F 21/22 |
| 2014/0325936 | A1 | 11/2014 | PSaila et al. | |
| 2016/0348381 | A1 | 12/2016 | Meyers | |
| 2019/0127989 | A1 | 5/2019 | Kell | |

* cited by examiner

*Primary Examiner* — Patrick J Maestri

(74) *Attorney, Agent, or Firm* — Scott Griggs; Griggs Bergen LLP

(57) ABSTRACT

A device for leveling and aligning tiles and a method for leveling and aligning tiles are disclosed. In one embodiment of the tile leveling device, a body defines a viewing opening. A base is orthogonally coupled to the body with a base to body coupling including a frangible breakaway section. The base and the body are integral prior to frangible separation and the frangible breakaway section, upon breaking, frangibly separates the body from the base. Respective arms are moveably connected to the body opposite the base. Each of the arms may operate from an open position to a closed position where the arm releasably mates one or more tiles.

20 Claims, 6 Drawing Sheets

DEVICE FOR LEVELING AND ALIGNING TILES AND METHOD FOR LEVELING AND ALIGNING TILES

PRIORITY STATEMENT & CROSS-REFERENCE TO RELATED APPLICATIONS

This application claims priority from U.S. Patent Application Ser. No. 62/836,927 entitled "Device for Leveling and Aligning Tiles and Method for Leveling and Aligning Tiles" filed on Apr. 22, 2019, in the names of Clinton D. Bunch and Joshua A. Bunch; which is hereby incorporated by reference, in entirety, for all purposes.

TECHNICAL FIELD OF THE INVENTION

This invention relates, in general, to tile installation and, in particular to a device for leveling and aligning tiles and properly spacing tiles during the installation thereof.

BACKGROUND OF THE INVENTION

Tile has become a popular decorative and functional article for use in floors, walls, countertops, and the like. Both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. A need exists for a device for leveling and aligning tiles and properly spacing tiles.

SUMMARY OF THE INVENTION

It would be advantageous to achieve a device for leveling and aligning tiles and properly spacing tiles. It would also be desirable to enable a mechanical-based solution that furnishes an inexpensive tool that assists professional tile installers and do-it-yourselfers. To better address one or more of these concerns, in one aspect of the invention, a device for leveling and aligning tiles and a method for leveling and aligning tiles are disclosed. In one embodiment of the tile leveling device, a body defines a viewing opening. A base is orthogonally coupled to the body with a base to body coupling including a frangible breakaway section. The base and body are integral prior to frangible separation and the frangible breakaway section, upon breaking, frangibly separates the body from the base. Respective arms are moveably connected to the body opposite the base. Each of the arms may move from an open position to a closed position where the arm releasably mates against one or more tiles. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
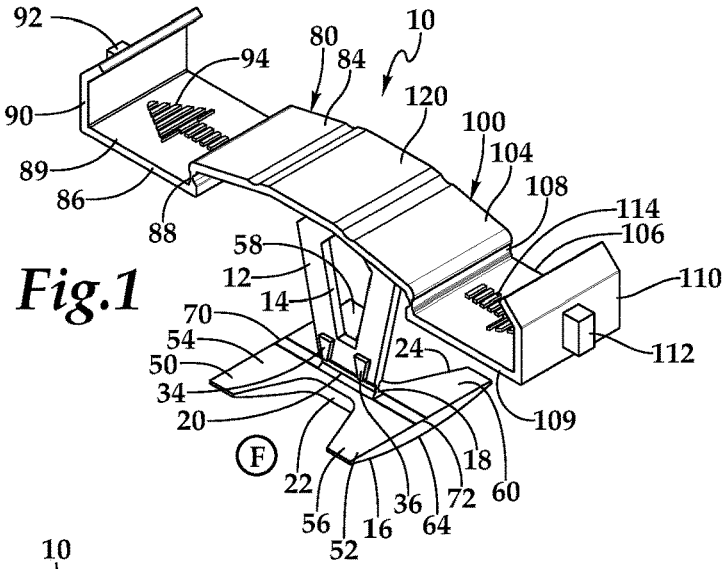
FIG. 1 is a front perspective view of one embodiment of a leveling device according to the teachings presented herein.
Figure 2:
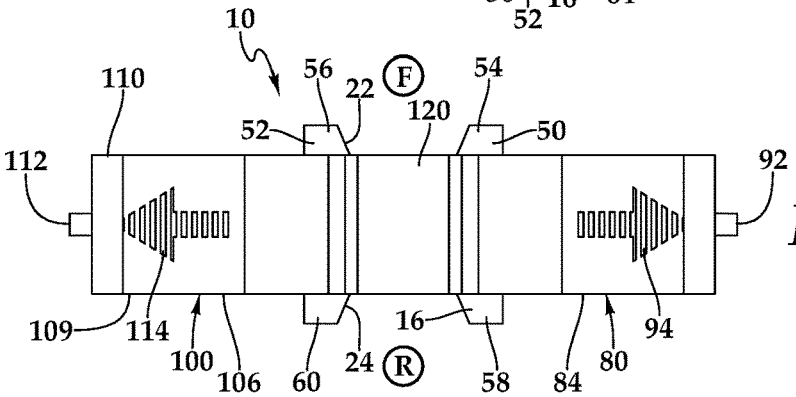
FIG. 2 is a top plan view of the leveling device presented in FIG. 1.
Figure 3:
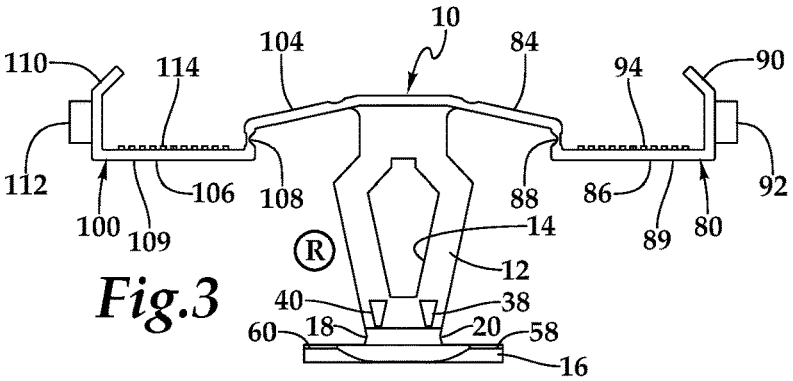
FIG. 3 is a rear elevation view of the leveling device presented in FIG. 1.
Figure 4:
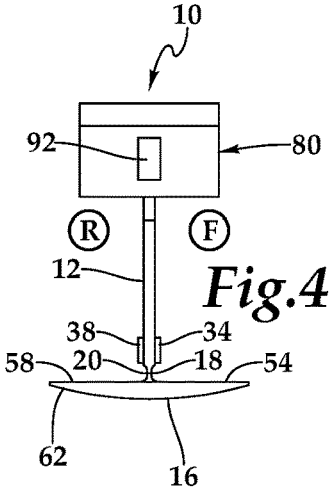
FIG. 4 is a left-side elevation view of the leveling device presented in FIG. 1.
Figure 5:
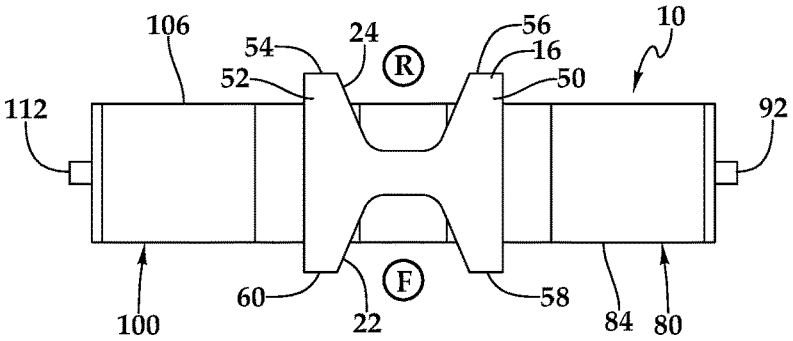
FIG. 5 is a bottom plan view of the leveling device presented in FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1 through FIG. 5, therein is depicted one embodiment of a tile leveling device that is schematically illustrated and generally designated 10. The tile leveling device 10 is utilized to align and level two, three, or four tiles, for example. The tile leveling device 10 includes a body 12 defining a viewing opening 14, which may provide a view through the body 12 to the other side of the tile joint for proper joint alignment. A base 16 may be orthogonally coupled to the body 12 and the base 16 extends to the front F of the body 12 and the base 16 extends to the rear R of the body 12. A base-to-body coupling 18 includes a frangible breakaway section 20. The body 12 and the base 16 are integral prior to frangible separation at the frangible breakaway section 20 and, upon breaking, frangibly separating the body 12 from the base 16. The frangible breakaway section 20 may be a frangible section of the body of reduced thickness that would promote the breakaway, and thus, separation of the body 12. The frangible breakaway section 20 may include one or more frangible breakaway section portions. By way of example, the body 12 may have two legs that form the base-to-body coupling 18. Although FIG. 1 through FIG. 5 show a single, continuous frangible breakaway section 20, as being discussed, it should be appreciated that the frangible breakaway section 20 may include one or more discrete subsections, including multiple discrete frangible breakaway subsections, that form the frangible breakaway section 20. A notch 22 may be formed at the base 16 and extends to the front F of the body 12 and the base 16. Similarly, a notch 24 may be formed at the base 16 and extends to the rear R of the body 12 and the base 16.

In one embodiment, a spacing pad (not shown) may be integral with the body 12 on the front F of the body 12 and may vary in thickness depending on the application. The spacing pad contributes to furnishing a combination of vertical leveling and joint spacing within a single product. Moreover, the spacing pad, which may be more generally a spacer, is configured to position the tiles a predetermined distance apart depending on the application. Similarly, a spacing pad (not shown) may be integral with the body 12 on the rear R of the body 12 and may vary in thickness depending on the application.

In one embodiment, grout joint spacers 34, 36 may be integral with the body 12 proximate the base 16 on the front F of the body 12 and may vary in thickness depending on the application. The grout joint spacers 34, 36 contribute to desired spacing within the grout joint and easy release therefrom. In one implementation, the grout joint spacers 34, 36 may be triangular in shape with the point of the triangle toward the base 16. The number of grout joint spacers 34, 36 may also vary. Similarly, grout joint spacers 38, 40 may be integral with the body 12 proximate the base 16 on the rear R of the body 12.

The base 16 may have any shape, including circular shapes, rectangular shapes, triangular shapes, or typographical shapes, like the letter "H" or "I." In one embodiment, the base 16 is an I-shaped base. Spaced and parallel strip members 50, 52 provide four points of contact 54, 56, 58, 60 for lift of tiles, while still establishing space for maximum mortar penetration between the spaced and parallel strip members 50, 52. As shown, the spaced and parallel strip members 50, 52 are substantially flat.

It should be appreciated, however, that the spaced and parallel strip members 50, 52 may have an arcuate form in an embodiment wherein the spaced and parallel strip members 50, 52 have a curve under the four points of contact 54, 56, 58, 60. That is, the spaced and parallel strip members 50, 52 may define convex curvatures 62, 64 that are flexible and compressible for tile installation during a leveling and alignment of a tile. The convex curvatures 62, 64 in this embodiment may contribute to tiles of varying thicknesses may be leveled and aligned. Continuing with the discussion of this embodiment, in the corner application, four tiles having four varying thicknesses may be leveled and aligned by way of the flexibility and compressibility of the convex curvatures 62, 64 of the spaced and parallel strip members 50, 52.

It should be understood that in alternative embodiments, the spaced and parallel strip members 50, 52 may be substantially flat, include arcuate portions on the top of the spaced and parallel strips members 50, 52, or include arcuate portions on the top of the spaced and parallel strip members 50, 52 in addition to the aforementioned convex curvatures 62, 64. In any of these alternative embodiments, in corner applications, four tiles having varying thicknesses may also be leveled and aligned by way of the flexibility and compressibility existing in the spaced and parallel strip members 50, 52, in addition to any benefits offered by arcuate portions or features of the alternate embodiments.

Channels 70, 72 may be located in the base 16 and, in one embodiment, the channels 70, 72 are perpendicular to the spaced and parallel strip members 50, 52. An arm 80 is pivotally connected to the body 12 opposite the base 16 by a central connection member 120. In one implementation, the arm 80 moves, and may pivot, from an open position to a closed position, as depicted by arrow 82 in FIG. 6A, where the arm 80 releasably mates against a tile $T_{1A}$. In the illustrated embodiment of FIG. 1 through FIG. 5, a lateral member 84 extends laterally from the body 12. The lateral member 84 is jointed to a generally L-shaped movable member 86 at a hinge point 88, which may provide a controlled point of bend or a region of enhanced flexibility, for example. The generally L-shaped movable member 86 includes a lengthwise stem 89 having a terminal member 90 projecting therefrom. The intersection of the lengthwise stem 89 and the terminal member 90 may be a point of enhanced flexibility, capable of compression. It should be appreciated that although an L-shaped movable member is described, the movable member may have other shapes. A downward facing tab 92 is secured to the terminal member 90. The downward facing tab 92 may releasably mate with a grout line G (FIGS. 7, 8, 9) between two tiles. A surface treatment 94 is applied to the lengthwise stem 89 to improve grip in one embodiment.

Figure 9:
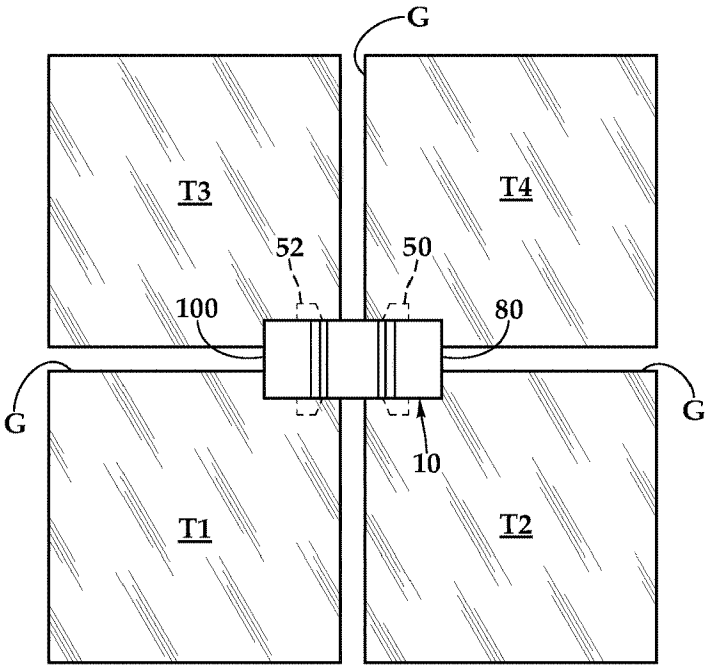
FIG. 9 is a top plan view showing an installation of four tiles using the leveling device in FIG. 1.
Figure 8:
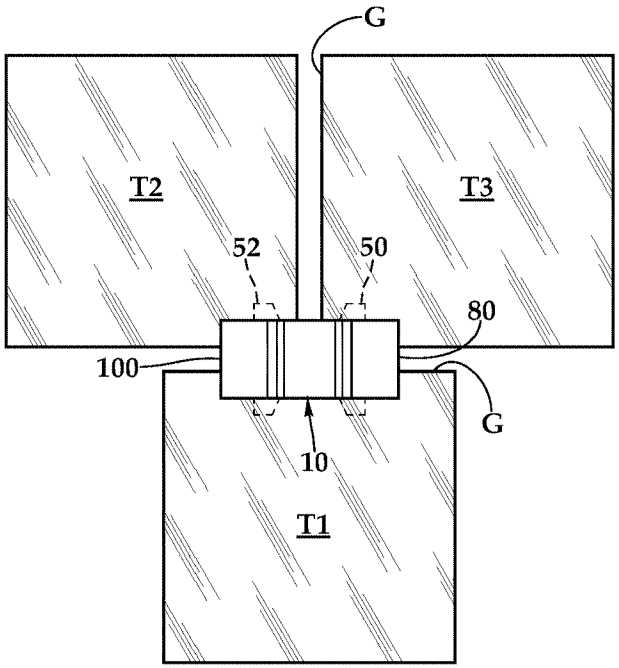
FIG. 8 is a top plan views showing an installation of three tiles using the leveling device in FIG. 1.

An arm 100 is pivotally connected to the body 12 opposite the base 16 by the central connection member 120, which in some embodiments may be part of the body 12. In one implementation, the arm 100 moves, by way of a hinge connection or pivot, for example, from an open position to a closed position, as depicted by arrow 102, where the arm 100 releasably mates against the tile T1 (FIGS. 7-9). In the illustrated embodiment, a lateral member 104 extends laterally from the body 12. The lateral member 104 is jointed to a generally L-shaped movable member 106 at a hinge point 108, which may provide a controlled point of bend. The L-shaped movable member 106 includes a lengthwise stem 109 having a terminal member 110 projecting therefrom. A downward facing tab 112 is secured to the terminal member 110. The downward facing tab 112 may releasably mate with a grout line G (FIGS. 7, 8, 9) between two tiles. A surface treatment 114 is applied to the lengthwise stem 109 to improve grip in one embodiment. A central connection member 120 couples the arm 80 to the arm 100. It should be appreciated that the design and function of the arms 80, 100 may vary by application. By way of example and not by way of limitation, additional bend points or pivot points may be included in the arms 80, 100 as well as the central connection member 120. Further, the arms 80, 100 may be provided with lengths sufficient to furnish tension forces and compression forces as described in more detail in FIG. 6A through FIG. 6C.

Figure 6A:
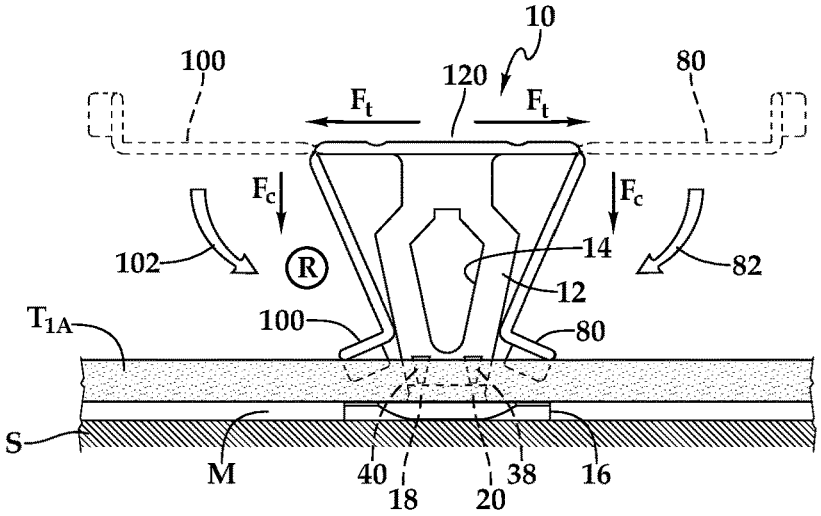
FIG. 6A is a rear elevation view showing an installation of a first tile using the leveling device in FIG. 1.
Figure 6B:
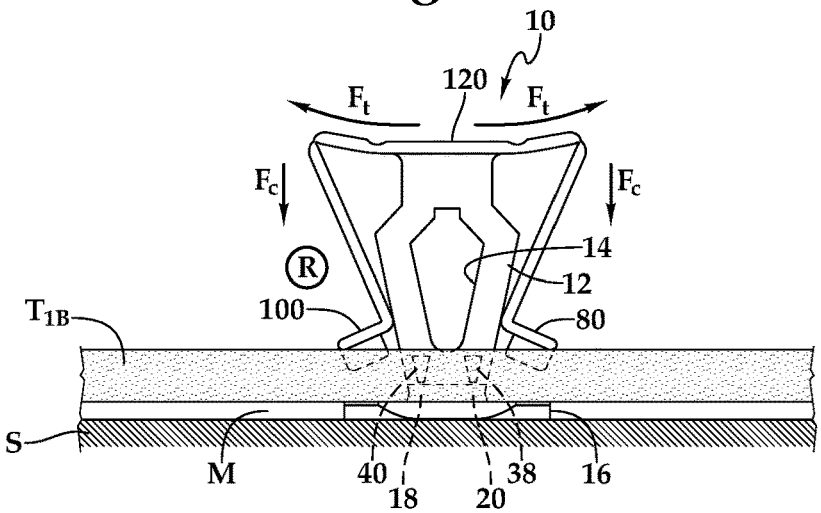
FIG. 6B is a rear elevation view showing an installation of a second tile using the leveling device in FIG. 1.
Figure 6C:
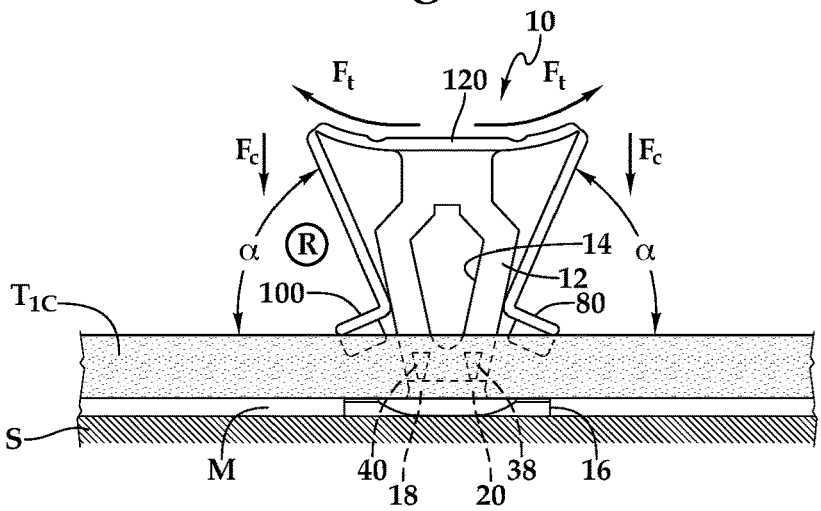
FIG. 6C is a rear elevation view showing an installation of a third tile using the leveling device in FIG. 1.
Figure 7:
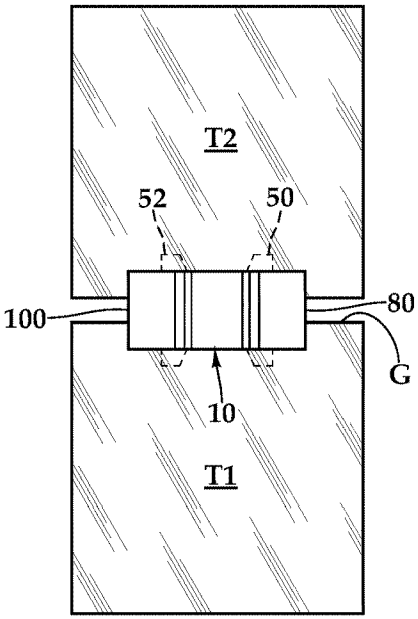
FIG. 7 is a top plan view showing installation of the two tiles using the leveling device as shown in FIG. 5.

Referring now to FIG. 6A through FIG. 6C, wherein the tile leveling device 10 may be utilized to level tile $T_{1A}$, tile $T_{1B}$, or tile $T_{1C}$, which are tiles of varying thicknesses. In operation, the tile leveling device 10 may accommodate tiles having different thicknesses. In some embodiments, the body 12 provides structural support while the arms 80, 100 secure the tiles by cantilevering from the body 12 with the use of tension forces $F_t$ having a horizontal component providing pressure and compression forces $F_c$ having a vertical component. With the use of the tension forces $F_t$ and compression forces $F_c$, in combination with an angle of contact $\alpha$ between the arm or the arm 100, a locking mechanism is not required. Rather, the compression forces $F_c$ associated with the arms 80, 100 keep the tile leveling device 10 in position. As shown in FIG. 6A, in some embodiments, depending on the thickness of the tile, the arms 80, 100 may extend outwardly and horizontally from the body 12 and then downwardly against the tile $T_{1A}$. As shown in FIG. 6B and FIG. 6C, the arms 80, 100 may extend outwardly and upwardly from the body 12 and then downwardly against the respective tile $T_{1B}$, $T_{1C}$. The outward and upward form of the arms 80, 100 is shown by the non-linear, convex form from the arm 80 to the central connection member 120 to the arm 100. As shown in FIG. 6A through FIG. 6C, the arms 80, 100 of the tile leveling device 10 have a range of tile leveling positions, where the arms contact tile, including a tile leveling position with the arms 80, 100 extending horizontally from the body 12 (FIG. 6A) and a tile leveling position with the arms 80, 100 extending upward from the body 12 (FIGS. 6A, 6B). In tile leveling positions with the arms 80, 100 extending horizontally from the body, minimal force is applied to achieve the tile leveling position with the amount force increasing as the arms 80, 100 are extended upwardly from the body 12.

Figure 15:
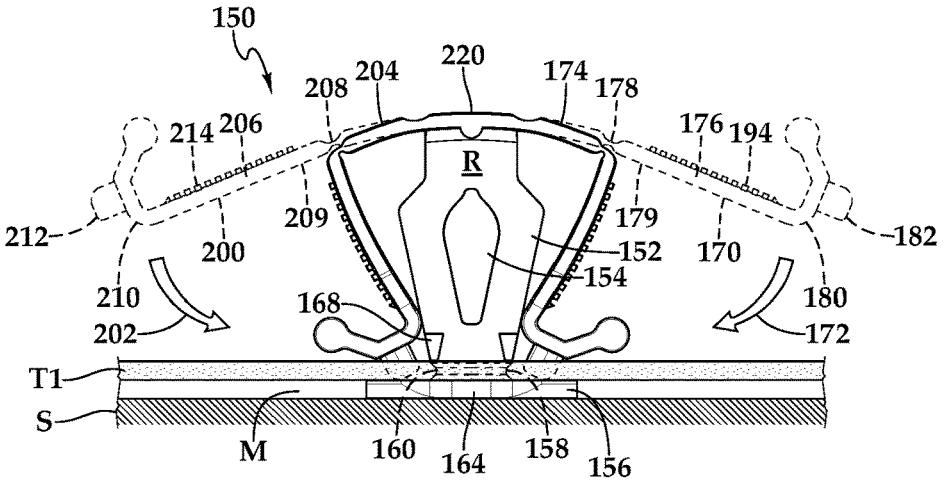
FIG. 15 is a rear elevation view showing an installation of a tile using the leveling device in FIG. 10.
Figure 21:
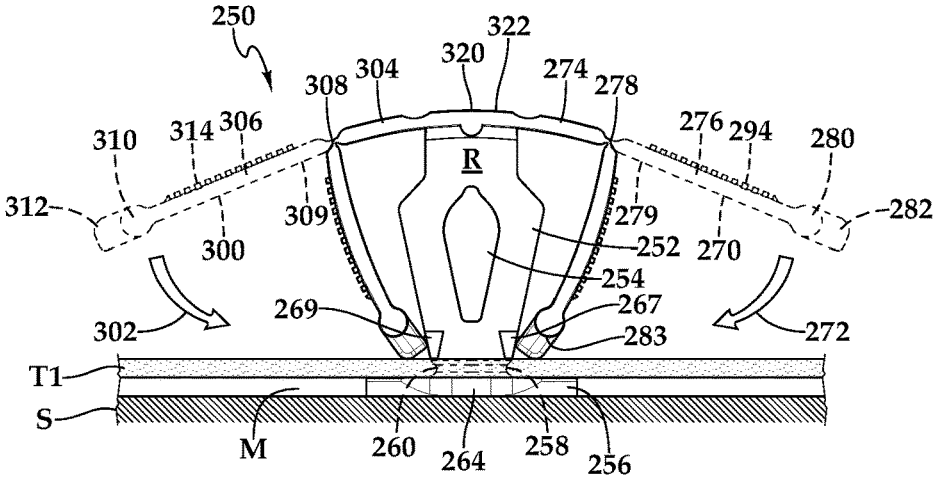
FIG. 21 is a rear elevation view showing an installation of a tile using the leveling device in FIG. 16.

Additionally, in particular embodiments, the tile leveling device 10 may include a tile leveling position with the arms 80, 100 extending immediately downwardly from the body 12 to define a concave convex form from the arm 80 to the central connection member 120 to the arm 100 (please see FIG. 15 and FIG. 21). Therefore, the arms 80, 100 in a tile leveling position may extend horizontally from the body 12 then downwardly toward tile; upwardly from the body 12 then downwardly toward tile; or, downwardly from the body 12 toward tile.

Referring now to FIG. 7 through FIG. 9, the tile leveling device 10 may be utilized with two tiles T1, T2 (FIG. 7), three tiles T1, T2, T3 (FIG. 8) or four tiles T1, T2, T3, T4 (FIG. 9) for installation on a substrate, subsurface, or other surface, which is indicated by the letter S having mortar M (FIGS. 6A, 6B, 6C). Grout lines G are located between each of the adjacent tiles. By way of example, in the two-tile installation, the tile T1 is positioned over the front portions of the spaced and parallel strip members 50, 52. The tile T1 has a lower surface opposite an upper surface, wherein the lower surface faces the spaced and parallel strip members 50, 52 and the subsurface S. The grout line G is the space between the two tiles T1, T2. The upper surface is farther from the spaced and parallel strip members 50, 52 than the lower surface and faces away from the spaced and parallel strip members 50, 52. The second tile T2 is similarly situated over the rear portions of the spaced and parallel strip members 50, 52 and includes a lower surface and an upper surface.

As shown, the tile T1 is over the base 16 to the front F of the body 12. As mentioned, the tile T1 has a lower surface opposite an upper surface. The tile T1 has contact with mortar M at the notch 22, wherein the lower surface faces the base 16 and the upper surface is farther from the base 16 than the lower surface. Similarly, the tile T2 is over the base 16 at the rear R of the body 12. The tile T2 has similar surfaces to the tile T1 with mortar M at the notch 24. The frangible breakaway section 20 may be located between the lower surface and the upper surface of the tile T1 and similarly positioned with respect to the tile T2.

In operation, an individual may place the tile leveling device 10 on the subsurface S and then position the mortar M and desired number of tiles. Each of the arms 80, 100 may be squeezed toward the body 12 such that the arms 80, 100 releasably engage against the tiles. In this configuration, the proper tile spacing may be maintained. Accordingly, a single tile leveling device 10 may be utilized to install, align, and level between two, three, and four tiles. More particularly, using one leveling device for a corner improves efficiency and minimizes the number of leveling devices required to complete a job.

Referring now to FIG. 10 through FIG. 15, therein is depicted another embodiment of a tile leveling device that is schematically illustrated and generally designated 150. The tile leveling device 150 is utilized to align and level two, three, or four tiles, for example. The tile leveling device 150 includes a body 152 defining a viewing opening 154, which may provide a view through the body 152 to the other side of the tile joint for proper joint alignment. A base 156 is orthogonally coupled to the body 152 and the base 156 extends to the front F of the body 152 and the base 156 extends to the rear R of the body 152. A base-to-body coupling 158 includes a frangible breakaway section 160. The body 152 and the base 156 are integral prior to frangible separation as the frangible breakaway section 160, upon breaking, frangibly separates the body 152 from the base 156. The frangible breakaway section 160 may be a frangible section of the body 152 of reduced thickness that would promote the breakaway, and thus, separation of the body 152. A notch 162 is formed at the base 156 and extends to the front F of the body 152 and the base 156. Similarly, a notch 164 is formed at the base 156 and extends to the rear R of the body 152 and the base 156. In one embodiment, the notches 162, 164 may be an isthmus forming a narrow strip of the base 156 to permit mortar M on either side, forming a tile-mortar-subfloor link at the isthmus. It should be appreciated that although the base 156 is depicted with the notches 162, 164, bases without notches are within the teachings presented herein.

In one embodiment, grout joint spacers 166 may be integral with the body 152 proximate the base 156 on the front F of the body 152 and may vary in thickness depending on the application. The grout joint spacers 166 contribute to desired spacing within the grout joint and easy release therefrom. Similarly, grout joint spacers 168 may be integral with the body 152 proximate the base 156 on the rear R of the body 152. The base 156 may have any shape, including circular shapes, rectangular shapes, triangular shapes, or typographical shapes, like the letter "H" or "I." In one embodiment, the base 156 is an I-shaped base.

An arm 170 is pivotally connected to the body 152 by a central connection member 220 opposite the base 156. In one implementation, the arm 170 moves by pivoting from an open position to a closed position, as depicted by arrow 172, where the arm 170 releasably mates against a tile $T_1$ by way of tension and compression forces. In the illustrated embodiment, a lateral member 174 extends laterally from the body 152. The lateral member 174 may be joined to a generally L-shaped movable member 176 at a hinge point 178, which may provide a controlled point of bend or a region of enhanced flexibility, for example. The L-shaped movable member 176 includes a lengthwise stem 179 having a terminal member 180 projecting therefrom. A downward facing tab 182 is secured to the terminal member 180. The downward facing tab 182 may releasably mate with a grout line G between two tiles. A surface treatment 194 is applied to the lengthwise stem 179 to improve grip in one embodiment.

Figure 10:
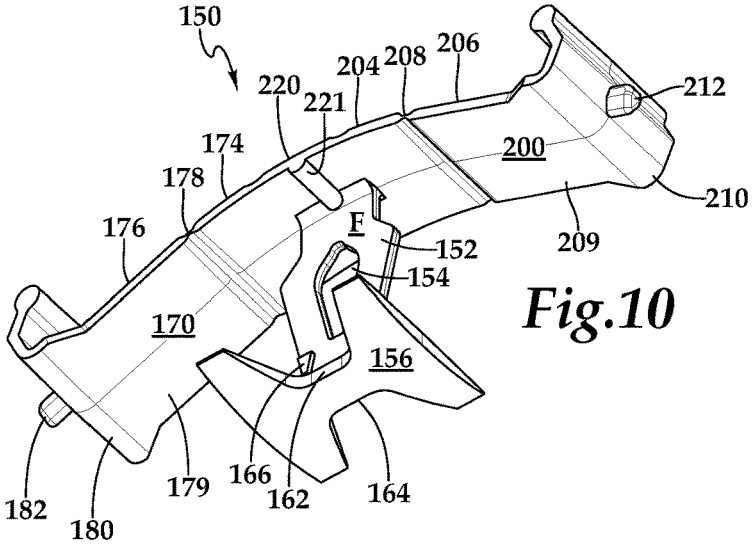
FIG. 10 is a bottom perspective view of another embodiment of a leveling device according to the teachings presented herein.
Figure 12:
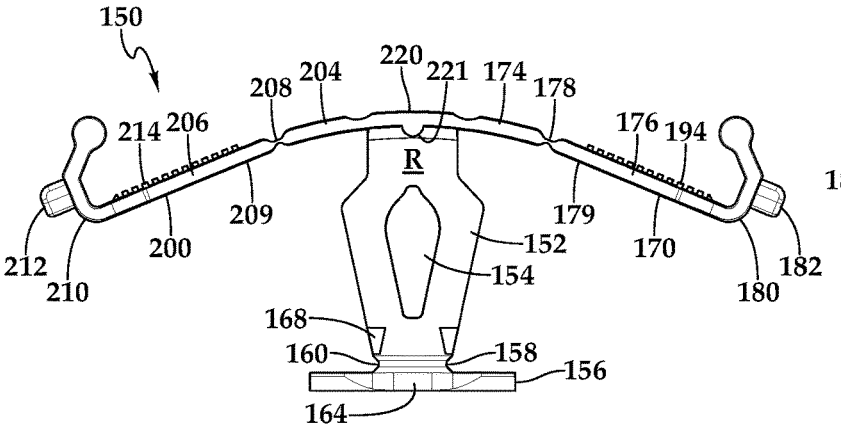
FIG. 12 is a rear elevation view of the leveling device presented in FIG. 10.
Figure 13:
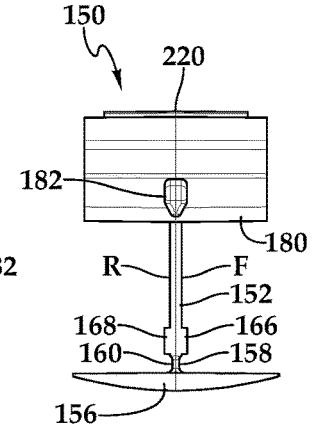
FIG. 13 is a left-side elevation view of the leveling device presented in FIG. 10.
Figure 11:
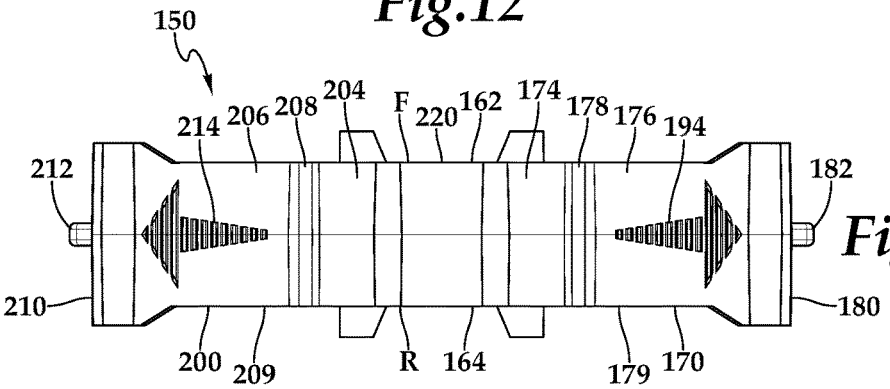
FIG. 11 is a top plan view of the leveling device presented in FIG. 10.
Figure 14:
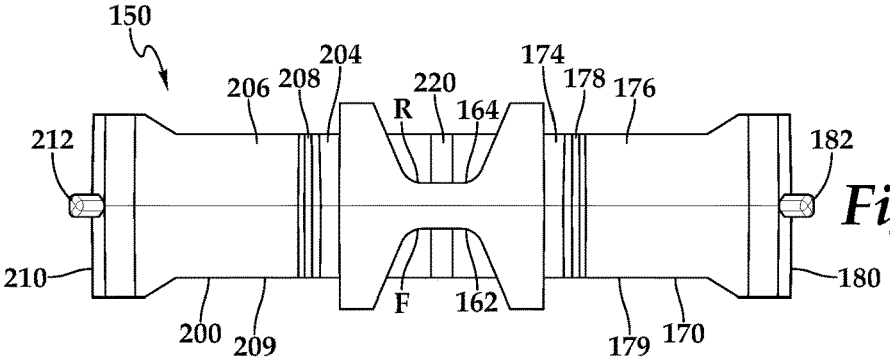
FIG. 14 is a bottom plan view of the leveling device presented in FIG. 10.

An arm 200 is pivotally connected to the body 152 by the central connection member 220 opposite the base 156 and pivots between an open position and a closed position, as shown by arrow 202. In the illustrated embodiment, a lateral member 204 extends laterally from the body 152 and may be joined to a generally L-shaped movable member 206 at a hinge point 208, which may provide a controlled point of bend. The L-shaped movable member 206 includes a lengthwise stem 209 having a terminal member 210 projecting therefrom. A downward facing tab 212 is secured to the terminal member 210. The downward facing tab 212 may releasably mate with a grout line G between two tiles. A surface treatment 214 is applied to the lengthwise stem 209 to improve grip in one embodiment. As mentioned, the central connection member 220 couples the arm 170 to the arm 200. As best seen in FIGS. 10 and 12, the central connection member 220 may include a support dowel 221 positioned perpendicular to the body 152 in order to provide increased stabilization during flexing of the arms 170, 200. Further, as shown, the arms 170, 200 may provide a flat wing design with offset wing hinges that have controlled bend points to start the turn downward.

Referring now to FIG. 16 through FIG. 21, therein is depicted a still further embodiment of a tile leveling device that is schematically illustrated and generally designated 250. The tile leveling device 250 is utilized to align and level two, three, or four tiles, for example. The tile leveling device 250 includes a body 252 defining a viewing opening 254, which may provide a view through the body 252 to the other side of the tile joint for proper joint alignment. A base 256 is orthogonally coupled to the body 252 and the base 256 extends to the front F of the body 252 and the base 256 extends to the rear R of the body 252. A base-to-body coupling 258 includes a frangible breakaway section 260. The body 252 and the base 256 are integral prior to frangible separation as the frangible breakaway section 260, upon breaking, frangibly separates the body 252 from the base 256. The frangible breakaway section 260 may be a frangible section of the body 252 of reduced thickness that would promote the breakaway, and thus, separation of the body 252. A notch 262 is formed at the base 256 and extends to the front F of the body 252 and the base 256. Similarly, a notch 264 is formed at the base 256 and extends to the rear R of the body 252 and the base 256. In one embodiment, the combination of the notches 262, 264 provide a majority of an area of tile-to-mortar-to-subfloor contact for the leveling device 250 within the bounds of the base 256. It should be appreciated that although the base 256 is depicted with the notches 262, 264, bases without notches are within the teachings presented herein. It should be further appreciated that other methods of creating more mortar contact between tiles and subfloor are within the teachings of the present invention. By way of example and not by way of limitation, the base 256 may include any combination of base elements such as holes, openings, notches, grooves, and the like to provide the appropriate amount of tile-to-mortar-to-subfloor contact.

In one embodiment, grout joint spacers 266, 268 may be integral with the body 252 proximate the base 256 on the front F of the body 252 and may vary in thickness depending on the application. The grout joint spacers 266, 268 contribute to desired spacing within the grout joint and easy release therefrom. Similarly, grout joint spacers 267, 269 may be integral with the body 252 proximate the base 256 on the rear R of the body 252. The base 256 may have any shape, including circular shapes, rectangular shapes, triangular shapes, or typographical shapes, like the letter "H" or "I." In one embodiment, the base 256 is an I-shaped base.

An arm 270 is moveably connected, by a hinge, pivot connection, living hinge or otherwise, for example, to the body 252 by a central connection member 320 opposite the base 256. In one implementation, the arm 270 pivots from an open position to a closed position, as depicted by arrow 272, where the arm 270 releasably mates against a tile $T_1$. In the illustrated embodiment, the arm 270 may have various flexure points, such as a flexure bearing member 274 and a flexure bearing member 276. Each of the flexure bearing members 274, 276 may provide a controlled point of bend or a region of enhanced flexibility, for example. It should be appreciated that the arm 270 may have one or more regions of enhanced flexibility such as region 278. That is, the arm 270 may be a flexible member pivoting in a flexure manner. The arm 270 may include a lengthwise stem 279 having a terminal member 280 projecting therefrom. A tab 282 is secured to the terminal member 280, such that the tab 282 extends from a flush end 283 of the arm 270 with the tab 282 having a smaller width than the flush end 283. The terminal member 280 may have a width $W_1$ with the tab 282 having a width W2, with the width W2 being less than the width $W_1$. The tab 282 may releasably mate, such as with a friction fit created by downward pressure and the aforementioned compression $F_c$, against one or more tiles, or with a grout line G between two tiles. A surface treatment 294 is applied to the lengthwise stem 279 to improve grip in one embodiment.

An arm 300 is pivotally connected, by a living hinge or otherwise, to the body 252 by the central connection member 320 opposite the base 256 and pivots between an open position and a closed position, as shown by arrow 302. In the illustrated embodiment, the arm 300 may have various flexure points, such as a flexure bearing member 304 and a flexure bearing member 306. Each of the flexure bearing members 304, 306 may provide a controlled point of bend or a region of enhanced flexibility, for example. That is, the arm 300 may be a flexible member pivoting in a flexure manner. It should be appreciated that the arm 300 may have one or more regions of enhanced flexibility such as region 308. The arm 300 may include a lengthwise stem 309 having a terminal member 310 projecting therefrom. A tab 312 is secured to the terminal member 310 and, by extension, secured to the arm 300, such that the tab 312 extends from a flush end 313 of the arm 300 with the tab 312 having a smaller width than the flush end 313. The terminal member 310 may have a width $W_3$ with the tab 312 having a width $W_4$, with the width $W_4$ being less than the width $W_3$. The tab 312 may releasably mate, such as with a friction fit, against one or more tiles, or with a grout line G between two tiles. A surface treatment 314 is applied to the lengthwise stem 309 to improve grip in one embodiment. As mentioned, the central connection member 320 couples the arm 270 to the arm 300. In one implementation, the central connection member 320 includes a non-linear form 322. Further, as shown, the arms 270, 300 may provide a flat wing design with offset wing hinges that have controlled bend points to start the turn downward.

Figure 22:
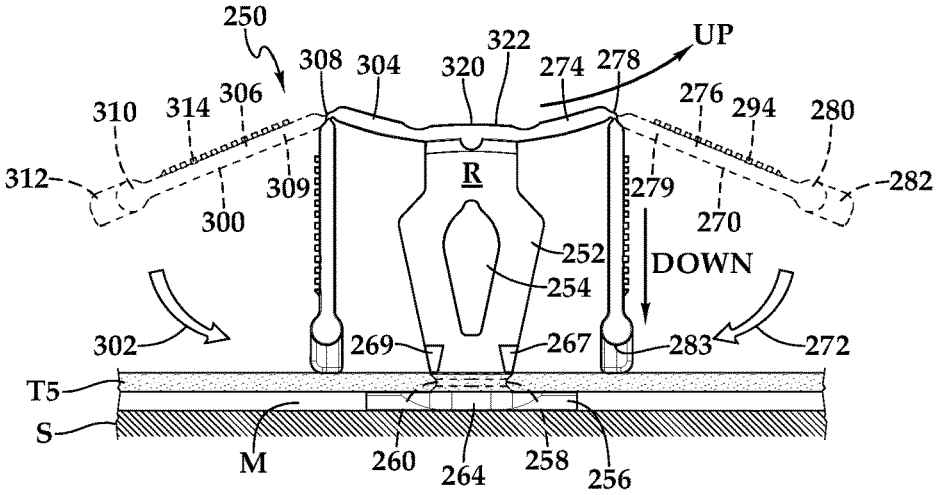
FIG. 22 is a rear elevation view showing an installation of another tile using the leveling device in FIG. 16.
Figure 16:
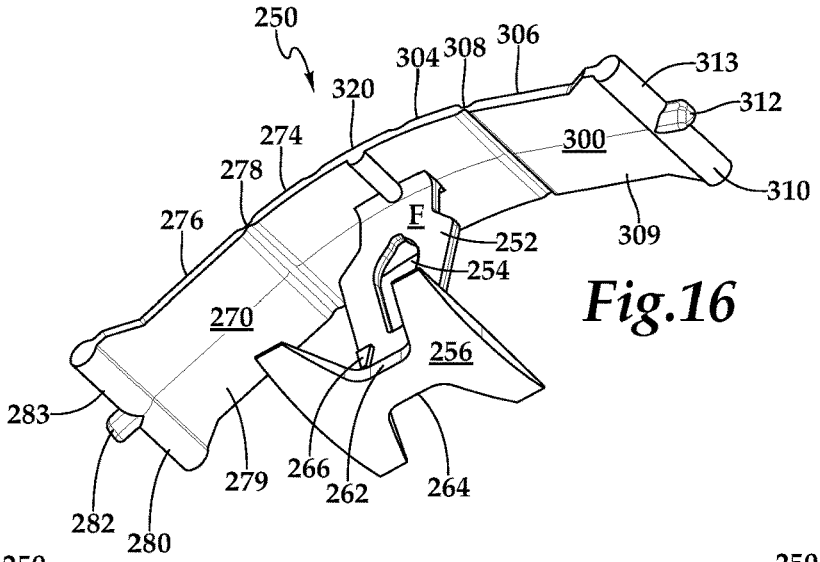
FIG. 16 is a bottom perspective view of a still further embodiment of a leveling device according to the teachings presented herein.
Figure 18:
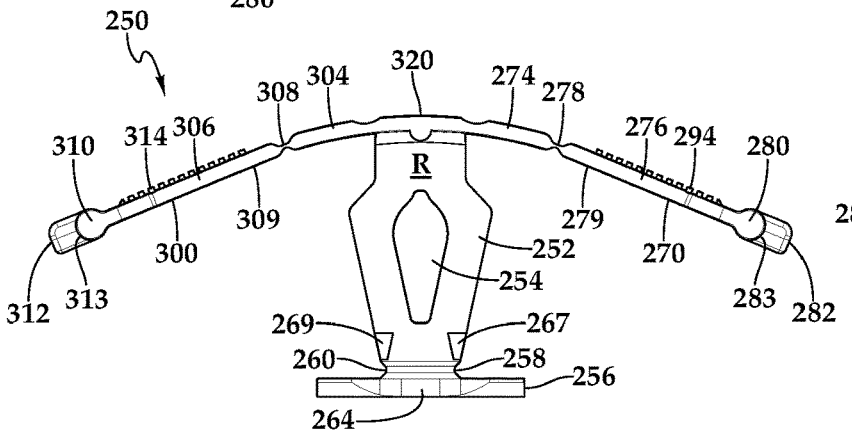
FIG. 18 is a rear elevation view of the leveling device presented in FIG. 16.
Figure 19:
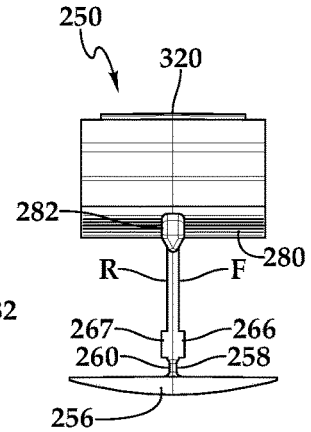
FIG. 19 is a left-side elevation view of the leveling device presented in FIG. 16.
Figure 17:
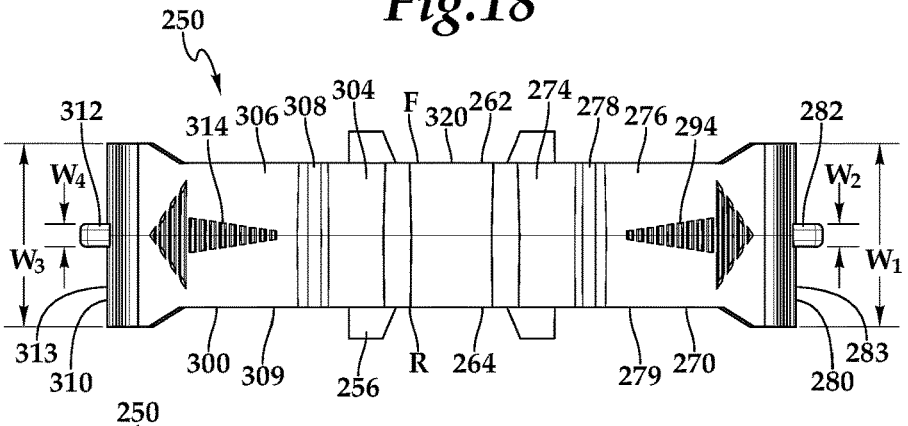
FIG. 17 is a top plan view of the leveling device presented in FIG. 16.
Figure 20:
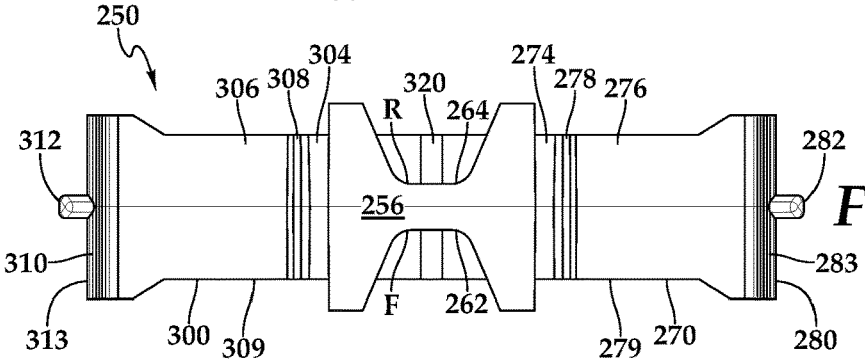
FIG. 20 is a bottom plan view of the leveling device presented in FIG. 16.

Referring now to FIG. 22, the tile leveling device 250 is utilized to align and level two, three, or four tiles, for example. It should be appreciated that the length of the arms 270, 300 may vary depending on the application. As shown, in this application with respect to tile T5, the arm 270 is moveably connected to the body 252 opposite the base 256 by the central connection member 320. The arm 270, due in part to its length and flexibility, includes a range of tile leveling positions where the arm 270 contacts tile T5, and the range of tile leveling positions include a tile leveling position having the arm 270 extending upwardly, as shown by the arrow labeled UP, from the body 252 then downwardly, as shown by the arrow DOWN, toward the tile T5 to contact the tile T5. Similarly, the arm 300 is moveably connected to the body 252 opposite the base 256 by the central connection member 320. The arm 300, due in part to its length and flexibility, includes a range of tile leveling positions where the arm 300 contacts the tile T5, and the range of tile leveling positions include a tile leveling position having the arm 300 extending upwardly then downwardly toward the tile T5 to contact the tile T5.

In some embodiments, the portion of the central connection member 320 and the arms 270, 300 which extend upwardly are flexible to provide a controlled bend, which may be convex or concave. The viewing opening 254 provides a window to see the other side of the tile leveling device 250 to assure proper alignment. The regions 278, 308 provide hinge points where the respective arms 270, 300 may bend and extend downward to the tile T5. At areas proximate the terminal member 280, 310 may have enhanced flexibility to provide greater ease of use. As mentioned, the tabs 282, 312 may be spacers that stabilize and prevent slipping of the arms 270, 300.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile leveling device comprising:

a body;

a base orthogonally coupled to the body, the base extending to a front of the body and the base extending to a rear of the body;

a base to body coupling including a frangible breakaway section, the base and the body being integral prior to frangible separation, the frangible breakaway section, upon breaking, frangibly separating the body from the base; and a first arm moveably connected to the body opposite the base by a central connection member, the first arm having a range of tile leveling positions where the first arm contacts a tile, the range of tile leveling positions including a tile leveling position having the first arm extending upwardly from the body then downwardly toward the tile to contact the tile.

2. The tile leveling device as recited in claim 1, wherein the first arm further comprises a flush end having a tab extending therefrom, the tab having a smaller width than the flush end.

3. The tile leveling device as recited in claim 2, wherein the tab of the first arm further comprises a spacer.

4. The tile leveling device as recited in claim 1, wherein the range of tile leveling positions of the first arm further comprises a tile leveling position having the first arm extending horizontally from the body then downwardly toward the tile to contact the tile.

5. The tile leveling device as recited in claim 1, wherein the range of tile leveling positions of the first arm further comprises a tile leveling position having the first arm extending downwardly from the body toward the tile to contact the tile.

6. The tile leveling device as recited in claim 1, further comprising a second arm moveably connected to the body opposite the base by the central connection member, the second arm having the range of tile leveling positions where the second arm contacts tile, the range of tile leveling positions including a tile leveling position having the second arm extending upwardly from the body then downwardly toward the tile to contact the tile.

7. The tile leveling device as recited in claim 6, wherein the second arm further comprises a flush end having a tab extending therefrom, the tab having a smaller width than the flush end.

8. The tile leveling device as recited in claim 7, wherein the tab of the second arm further comprises a spacer.

9. The tile leveling device as recited in claim 6, wherein the range of tile leveling positions of the second arm further comprises a tile leveling position having the second arm extending horizontally from the body then downwardly toward the tile to contact the tile.

10. The tile leveling device as recited in claim 6, wherein the range of tile leveling positions of the second arm further comprises a tile leveling position having the second arm extending downwardly from the body toward the tile to contact the tile.

11. The tile leveling device as recited in claim 1, wherein the body further comprises a spacer extending transversely from the front and rear of the body, the spacer configured to position first and second tiles a predetermined distance apart.

12. The tile leveling device as recited in claim 1, wherein a viewing opening in the body provides a line-of-sight to the tile.

13. The tile leveling device as recited in claim 1, wherein the base further comprises a first notch formed at the base extending to the front of the body and a second notch formed at the base extending to the rear of the body.

14. The tile leveling device as recited in claim 1, wherein the base further comprises base elements selected from the group consisting of holes, openings, notches, and grooves.

15. The tile leveling device as recited in claim 1, wherein the central connection member forms a portion of the body.

16. The tile leveling device as recited in claim 1, wherein the base further comprises a shape selected from the group consisting of I-shapes, circular shapes, rectangular shapes, triangular shapes, and typographical shapes.

17. The tile leveling device as recited in claim 1, wherein the frangible breakaway section further comprises one discrete frangible breakaway subsection.

18. The tile leveling device as recited in claim 1, wherein the frangible breakaway section further comprises a plurality of discrete frangible breakaway subsections.

19. A tile leveling device comprising:

a body defining a viewing opening, the viewing opening providing a view through the body to an opposite side of a tile joint for proper joint alignment;

a base orthogonally coupled to the body, the base extending to a front of the body and the base extending to a rear of the body;

abase to body coupling including a frangible breakaway section, the base and the body being integral prior to frangible separation, the frangible breakaway section, upon breaking, frangibly separating the body from the base;

a first arm moveably connected to the body opposite the base by a central connection member, the first arm having a range of tile leveling positions where the first arm contacts tile, the range of tile leveling positions including a tile leveling position having the first arm extending upwardly from the body then downwardly toward the tile to contact the tile; and a second arm moveably connected to the body opposite the base by the central connection member, the second arm having a range of tile leveling positions where the second arm contacts tile, the range of tile leveling positions including a tile leveling position having the second arm extending upwardly from the body then downwardly toward the tile to contact the tile.

20. A tile leveling device comprising:

a body defining a viewing opening, the viewing opening providing a view through the body to an opposite side of a tile joint for proper joint alignment;

a base orthogonally coupled to the body, the base extending to a front of the body and the base extending to a rear of the body;

a base to body coupling including a frangible breakaway section, the base and the body being integral prior to frangible separation, the frangible breakaway section, upon breaking, frangibly separating the body from the base;

a first arm moveably connected to the body opposite the base by a central connection member, the first arm having a range of tile leveling positions where the first arm contacts tile, the range of tile leveling positions including a tile leveling position having the first arm extending upwardly from the body then downwardly toward the tile to contact the tile;

the first arm including a flush end to contact the tile, the flush end having a tab extending therefrom, the tab having a smaller width than the flush end;

a second arm moveably connected to the body opposite the base by the central connection member, the second arm having a range of tile leveling positions where the second arm contacts tile, the range of tile leveling positions including a tile leveling position having the second arm extending upwardly from the body then downwardly toward the tile to contact the tile; and the second arm including a flush end to contact the tile, the flush end having a tab extending therefrom, the tab having a smaller width than the flush end.

* * * * *